US005201503A

United States Patent [19]

Matsui et al.

[11] Patent Number: 5,201,503

[45] Date of Patent: Apr. 13, 1993

[54] SHEET SORTER WITH COMMON SUPPLY AND DISCHARGE ROLLERS

[75] Inventors: Toshikazu Matsui, Kishiwada; Hiromi Sakata, Suita; Masanori Itakiyo, Sakai; Kunihiko Ishikawa, Osaka; Kenzo Ono, Habikino, all of Japan

[73] Assignee: Mita Industrial Co., Ltd., Japan

[21] Appl. No.: 778,361

[22] Filed: Oct. 17, 1991

[30] Foreign Application Priority Data

Oct. 25, 1990 [JP] Japan ..... 2-289783

[51] Int. Cl.[5] ..... B42B 2/00; B65H 39/02

[52] U.S. Cl. ..... 270/53; 270/58

[58] Field of Search ..... 270/52, 53, 58, 37

[56] References Cited

U.S. PATENT DOCUMENTS

| | | | |
|---|---|---|---|
| 4,681,310 | 7/1987 | Cooper | 270/53 |
| 4,687,191 | 8/1987 | Stemmle | 270/53 |
| 4,946,152 | 8/1990 | Ishikawa | 270/53 |
| 5,044,625 | 9/1991 | Reid | 270/53 |
| 5,088,709 | 2/1992 | Yamamoto | 270/53 |
| 5,100,119 | 3/1992 | Komada | 270/53 |
| 5,141,215 | 8/1992 | Ishiguro et al. | 270/52 X |

FOREIGN PATENT DOCUMENTS

| | | | |
|---|---|---|---|
| 263696 | 10/1990 | Japan | 270/53 |

*Primary Examiner*—Edward K. Look
*Assistant Examiner*—John Ryznic
*Attorney, Agent, or Firm*—Beveridge, DeGrandi, Weilacher

[57] ABSTRACT

A sorter incorporating a stapler sorts and staples sheets discharged from a discharger of an image forming apparatus. The sorter includes a plurality of bins, a stapler, a stacker, and a supplying/discharging mechanism. The plurality of bins are vertically arranged and vertically movable. The stapler staples a stack of sheets stored in each of the bins. The stacker stores the bundles of sheets stapled by the stapler. The supplying/discharging mechanism supplies into the bins of the sorter the sheets discharged from the discharger, and discharges the bundles of sheets stapled by the stapler into the stacker.

18 Claims, 8 Drawing Sheets

SHEET SORTER WITH COMMON SUPPLY AND DISCHARGE ROLLERS

BACKGROUND OF THE INVENTION

The present invention relates generally to sorters. More specifically, it relates to a sorter incorporating a stapler for stapling stacks of sheets.

A conventional copying machine may be provided with a sorter for sorting and storing image-formed sheets, and a type of sorter includes a stapler for stapling stacks of sheets.

Japanese Patent Laying-Open No. 231757/1989 discloses one of the conventional sorters which incorporates a stapler. This sorter is provided with a plurality of receiving bins into which sheets are sorted in order. The bins are vertically disposed and vertically movable. A sheet supplier provided near the lower end of the bins supplies sheets discharged from a copying machine into the bins. A stapler for stapling the stacks of sheets stored in the bins is provided in the sheet supplier.

In this conventional sorter, a predetermined gap is provided between adjacent bins through which sheets are transported from the sheet supplier into the bins. The stack of sheets stored in each bin is stapled by the stapler. The stapler is rotatable through a predetermined angle between a drawn position, to clear the movement of the bins, and a stapling position at which the stapling operation is executed.

Japanese Patent Laying-Open No. 23154/1990 discloses another sorter having a plurality of bins each of which is immobile. Sheets from a copying machine are transported into the bins by corresponding claws provided in a transporting mechanism. In the sorter is a vertically movable stapler.

The stapling operation of the sorter is performed as follows: the stapler is moved vertically; a nipper draws a stack of sheets from a bin into a stapling position; the stapler staples the stack of sheets; and the nipper moves the stack of sheets back into the bin.

In the sorter disclosed in Japanese Patent Laying-Open No. 231757/1989, the stapler is provided in the sheet supplier, wherein the stapler is potentially an obstruction to the vertical movement of the bins. Consequently, it is necessary to provide a mechanism for rotating the stapler between the stapling position and the drawn position, which thus complicates the structure. In the sorter disclosed in Japanese Patent Laying-Open No. 23154/1990, it is necessary to provide, in addition to the stapler, a device which draws each stack of sheets from, and returns each stack into the bins, therein complicating the structure as well.

These two conventional sorters, however, cannot accommodate any number of stacks of sheets greater than the number of bins. Therefore, when a larger number of copy bundles are to be produced, an operator must empty stapled stacks of sheets from the bins in order to allow the succeeding stacks of sheets to be formed in the bins. A plurality of sorters could be provided in order to process a larger number of copies but they would occupy a greater amount of space.

Japanese Patent Laying-Open No. 165270/1988 discloses a sorter having a sorting portion and a stacking portion. In this sorter, stacks of sheets temporarily stored in the sorting portion are transported to the stacking portion, where they are stapled by a stapler provided therein. Accordingly, the sorter can handle a larger number of stacks of sheets than the number of bins provided in the sorting portion.

In the sorter disclosed in Japanese Patent Laying-Open No. 165270/1988, however, the stacks of sheets temporarily stored in the sorting portion tend to become disarranged while they are transported toward the stacking portion, making it less manageable to achieve properly arranged and stapled stacks within the stacking portion.

SUMMARY OF THE INVENTION

An object of the present invention is to simplify the structure of a stapler incorporated into a sorter.

Another object of the present invention is to enable a sorter incorporating a stapler to be readily capable of stapling a number of sheet stacks greater than the number of bins and storing the stapled stacks.

(1) A sorter having a stapler according to an aspect of the present invention includes a plurality of bins, a stapler, a bundle stacker or stocker, and a supply/discharge unit.

The plurality of bins stores supplied sheets. The bins are vertically disposed and vertically movable. The stapler staples a stack of sheets stored in each of the bins. The stacker or stocker stores the bundles of sheets stapled by the stapler. The supply/discharge unit supplies sheets to the bins, and discharges stapled stacks of sheets.

In the sorter, sheets transported from an adjacent machine are supplied to the bins by the supply/discharge unit. The bins more in vertically succession, whereby the sheets from the supply/discharge unit are sorted and stored into the successive bins. After stacks of sheets have been stored into the bins, each bin in turn moves into a stapling position wherein the stack of sheets stored in the bin is stapled by the stapler. The stapled stack of sheets is discharged into the stocker by the supply/discharge unit.

Thus, the stapled stacks of sheets are discharged into a stocker which is distinct from the bins themselves. Consequently in a given operation, it is possible to sort sheets and staple them into a number of bundles greater than the number of bins, and when the sorter is applied to a copying machine processing a high volume of copies, the sorter can dispatch its handling of the copies quickly. In addition, since the unit for supplying transported sheets to the bins is also used for discharging the stapled stacks of sheets into the stocker, the sorter structure is compact.

(2) A sorter having a stapler according to another aspect of the present invention includes a plurality of bins, a sheet supplier, a stapler, and a bin transporting unit.

The bins store supplied sheets. They are vertically disposed and vertically movable. The sheet supplier supplies sheets transported from an adjacent machine to the bins. The stapler, is vertically adjacent to the sheet supplier, staples the stack of sheets stored in each bin. The bin transporting unit moves the bins in vertical succession while maintaining predetermined spacings above and below a bin which is positioned at the level of the stapler, and above a bin which is positioned at the level of the sheet supplier.

Thus, the stapler and the sheet supplier can be located at different positions yet within close range. Accordingly, the sorter can be made compact, and the structure of the sorter is simplified because it is not necessary to provide any mechanism for rotating the stapler.

(3) A sorter having a stapler according to a further aspect of the present invention includes bins, a stapler, a stocker, and a discharging mechanism.

Each bin stores supplied sheets, and has a bottom cutout and a sheet stop of a predetermined height at one end. The stapler staples a stack of sheets in a given bin. The stocker stores the stapled stack of sheets. The discharging mechanism moves upward through the bottom cutout of the bin to raise an end of the stapled stack of sheets in the bin above the sheet stop, whereby the stack of sheets is discharged into the stocker.

In the sorter, supplied sheets are stored into the bin. The stack of sheets stored in the bin is stapled by the stapler. In order to discharge the stapled stack of sheets from the bin, the discharging mechanism moves upward through the cutout in the bottom of the bin to raise the adjacent end of the stack to that level which allows the stack to pass over the stop at the end of the bin. The stack of sheets thus raised is discharged into the stocker, provided separately from the bin.

In this manner, the sorter in a given operation can dispatch a number of sheet bundles greater than the number of bins, and a greater volume of sheets can be processed at high speed.

Furthermore, the sheet bundles in the bins are smoothly discharged into the stocker as they are raised to just above the bin stops, making it unnecessary to change the position of the bins nor to provide a complicated discharging mechanism.

These and other objects and advantages of the present invention will be more fully apparent from the following detailed description.

DESCRIPTION OF THE PREFERRED EMBODIMENT

Figure 1:
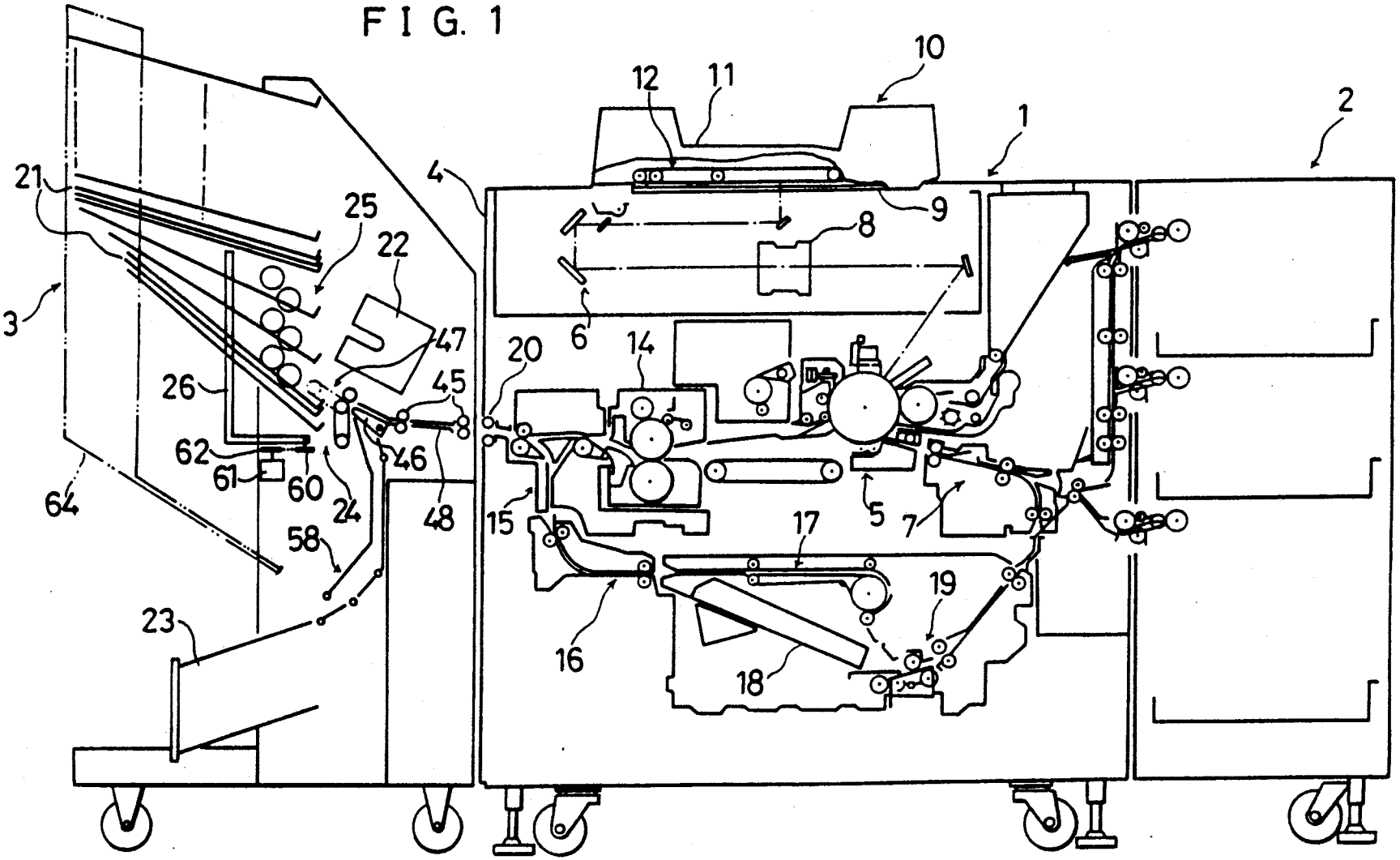
FIG. 1 is a schematic sectional view of a copying machine comprehending a sorter incorporating a stapler according to an embodiment of the present invention.

As shown in FIG. 1, the copying machine has a main body 1, a sheet feeding unit 2 fixed on the right side of the body 1, and a sorter 3 incorporating a stapler on the left side of the body 1. The copying machine body 1 has a case 4, an image forming unit 5 provided in a central portion of the case 4, an original scanner 6 provided above the image forming unit 5, and a sheet transporting path 7 through which sheets are supplied to the image forming unit 5 and discharge therefrom.

The image forming unit 5 comprises a photoconductive drum disposed in the middle, and a charger, a developing unit, a transfer unit, a paper separator, and a cleaning unit disposed around the photoconductive drum.

The original scanner 6 includes an optical exposure system 8 disposed above the image forming unit 5, an original support 9 disposed over the optical exposure system 8, and an automatic original feeder 10 provided on the orignal support 9. The automatic original feeder 10 includes an original locating portion 11 provided in an upper surface of the feeder case, and an original transporting system 12 disposed inside the case and having an original transporting belt and associated elements in order to circulate originals between the upper surface of the original support 9 and the original locating portion 11.

The sheet transporting path 7 includes a sheet supplying path on the right side of the image forming unit 5 in FIG. 1, and a sheet discharging path on the left side thereof. A fixing unit 14 is provided in the sheet discharging path. On the outlet-side of the fixing unit 14, there are provided discharge rollers 20 for discharging sheets to the sorter 3, and a sheet reversing device 15. p In a lower part of the case 4, there are provided a lower transporting path 16 for transporting a sheet received from the reversing device 15, a turning unit 17 for turning the sheet transported through the lower transporting path 16, a temporary storing tray 18 for temporarily storing the turned sheet, and a sheet refeeder 19 for refeeding the sheet from the tray 18.

The sorter 3 includes a plurality of bins 21 disposed vertically, a stapling device 22, a stocker or stocker 23 disposed under the plurality of bins 21 for storing stapled bundles of sheets, a supply/discharge mechanism 24 for supplying sheets from the copying machine body 1 to the bins 21, and discharging stapled stacks of sheets therefrom, a bin moving mechanism 25 for moving the bins 21 vertically, and lateral guides 26 which come into abutment with either side of the sheets stored in the bins 21.

Figure 2:
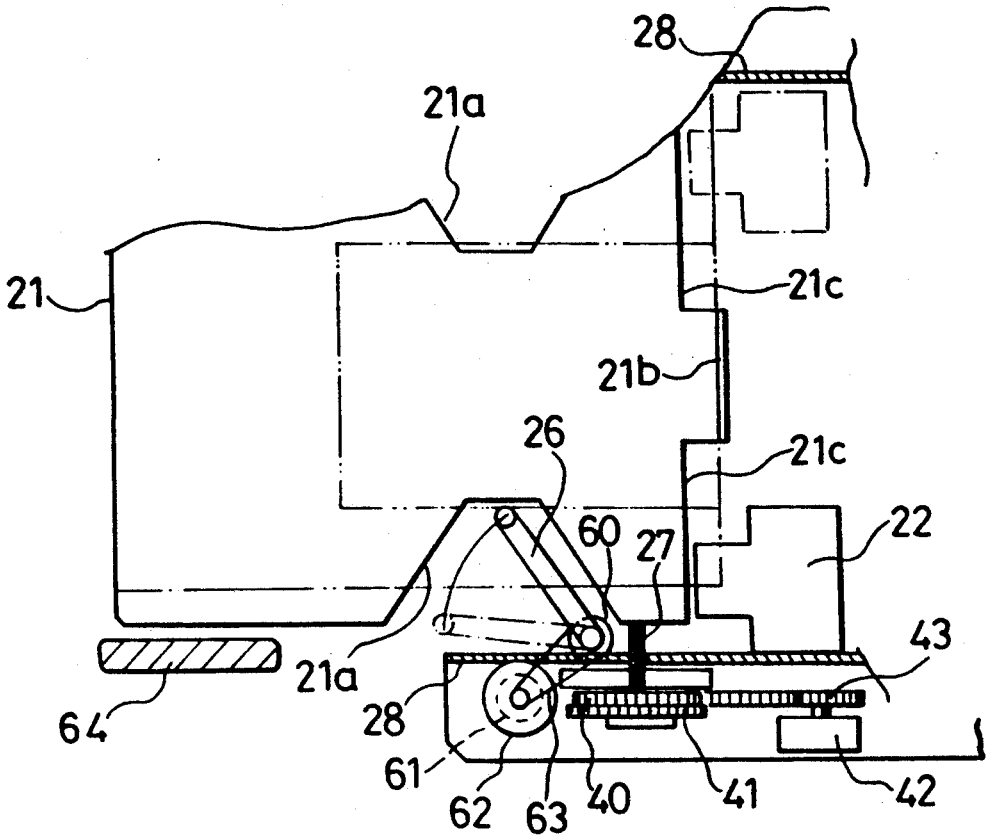
FIG. 2 is a partial plan view of the sorter.
Figure 3:
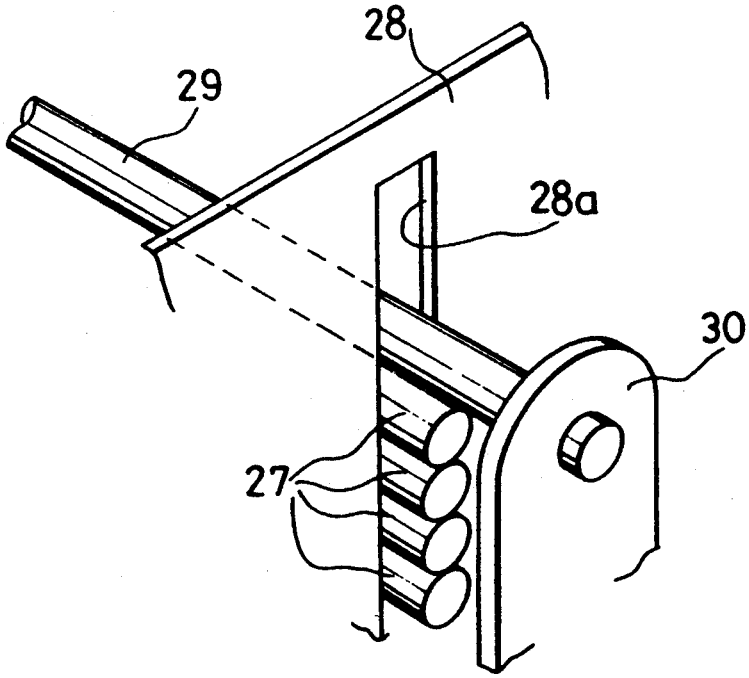
FIG. 3 is a partial perspective view of the sorter.

Each bin 21 includes a substantially rectangular plate member as shown in FIG. 2. Each bin 21 has a central portion provided with cutouts 21*a* on either side. The side cutouts 21*c* are provided on either side of a given end of each bin 21, i.e., the right end in FIG. 1, onto which the trailing edges of sheets are positioned. In effect, a central portion of the right end of each bin 21 projects along its sheet entrance side, and the trailing edges of the sheets stored in each bin 21 are exposed by the cutouts 21*c*. The projecting central portion of each bin 21 is provided with a stop 21*b* extending upward to adjust the end of the sheet stack. Trunnions 27 are provided on either side of the right end of each bin 21. A sub frame 28 of the sorter 3, flanking either side of the bins 21, comprises a vertically extending guide groove 28*a* as shown in FIG. 3. The trunnions 27 of the bins 21 project outwardly through the guide grooves 28*a* on either side.

Figure 4:
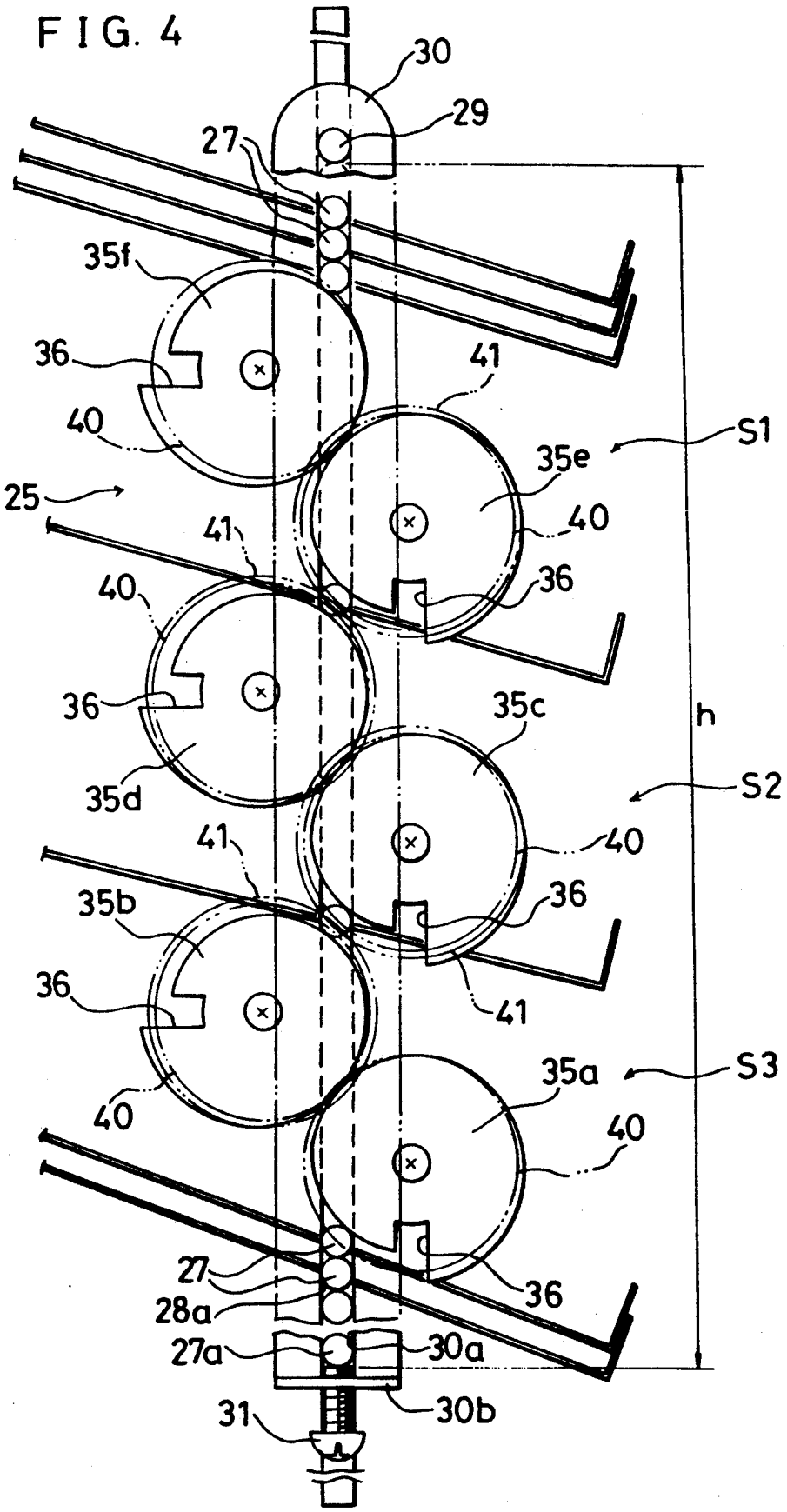
FIG. 4 is a schematic front view showing a bin moving mechanism of the sorter.

As shown in FIG. 3, the trunnions 27 on either side of the bins 21 contact one another and move together vertically in their corresponding guide groove 28*a*. A rod 29 extending in the sheet width direction is provided on the trunnions 27 of the uppermost bin 21. Both ends of the rod 29 project beyond the trunnions 27, and on either side of the rod 29 the upper end of a bar 30 is affixed. As shown in FIG. 4, the trunnions 27*a* of the lowermost bin 21 project beyond the other trunnions 27, and extend to essentially the same length as the rod 29. Each of the trunnions 27*a* of the lowermost bin 21 is inserted into a groove 30*a* of predetermined length provided in the lower end of the corresponding bar 30. A horizontal portion 30*b* projects from the lower end of the bar 30 on either side, and a regulating screw 31 is inserted into both horizontal portions 30*b* from below. The upper end of the regulating screw 31 makes contact with the underside of the trunnion 27*a*, and by using the regulating screws 31, are employed to adjust the height from the lowermost trunnion 27a to the uppermost trunnion 27 on either side. The distance h from bottom of the lowermost trunnion 27a to the summit of the uppermost trunnion 27 is adjusted as follows:

$$h \approx n \times d + \alpha$$

where n is the number of bins (the number of trunnions on either side); d is the diameter of each trunnion 27; and $\alpha$ is the total spacing of the four trunnions set apart by bin moving mechanisms 25 described below.

Both moving mechanisms 25 comprise first to sixth cams 35a to 35f as shown in FIG. 4. Each of the cams 35a to 35f is recessed by a slot 36 in the radial direction as shown. Each slot 36 is of such size as to contain one trunnion, whereby the trunnions 27 can be engaged one after another. The outer surface of each of the cams 35a to 35f is an equivalent portion of an Archimedes'spiral. Specifically, if the minimum radius of each cam is a, the radius r of the cam at a position rotated by an angle $\theta$ from the position corresponding to the minimum radius a is as follows:

$$r = a + m\theta$$

where m is a constant.

The first and second cams 35a and 35b are disposed at a rotational phase difference of $\pi/2$. The third and fourth cams 35c and 35d, and the fifth and sixth cams 35e and 35f are respectively disposed at the same rotational phase difference as that between the first and second cams 35a and 35b. The first, third and fifth cams 35a, 35c and 35e are in phase rotationally, whereas the second, fourth and sixth cams 35b, 35d and 35f are in phase rotationally. The second and third cams 35b and 35c are disposed such that the distance between their centers and their rotational phase difference is according to the following relation. The positioning of the cams 35b and 35c shown in FIG. 4 is such that a corresponding trunnion 27 may be located therebetween, and further that when the trunnion 27 is engaged into the slot 36 of either of the cams 35b or 35c by their rotation, the outer surfaces of the cams 35b and 35c are in contact with each other. The fourth and fifth cams 35d and 35e are also positioned according to the same relation.

Each cam series 35a to 35f is driven by a gear train as shown in FIG. 2 comprising gears concentrical with the central shafts of corresponding cams. The first and second cams 35a and 35b, the third and fourth cams 35c and 35d, and the fifth and sixth cams 35e and 35f are coupled by engagements of small gears 40 provided on the respective cams. The second and third cams 35b and 35c, and the fourth and fifth cams 35d and 35e having a relatively larger distance between their centers are coupled by engagements of large gears 41. The small gear 40 and the large gear 41 of each of the second to fifth cams 35b to 35e are disposed concentrically and adjacent to each other in the axial direction. The large gear 41 fixed to the third cam 35c, and the large gear 41 fixed to the fourth cam 35d are disposed with a gap between them in the axial direction so as not to interfere with each other.

The small gear 40 of the first cam 35a is coupled with a drive gear 43 connected to a drive motor 42 by means of another gear train.

Predetermined spaces S1 to S3 (as shown in FIG. 4) are effected between adjacent bin 21 as moved by the bin moving mechanism 25. The upper and lower portions of the stapling device 22 are accommodated within the spaces S1 and S2, respectively, and the supply/discharge mechanism 24 is accommodated within the space S3.

The stapling device 22 is located on the sheet-entrance side of the bin 21 as shown in FIG. 2, and is movable in the sheet width direction as well as in the direction perpendicular thereto.

The supply/discharge mechanism 24 hereinafter will be described.

As shown in FIG. 1, the supply/discharge mechanism 24 includes transport rollers 45 for transporting sheets from the copying machine body 1, a claw 46 for changing the sheet transporting direction, a transport roller mechanism 47 and transport guide plates 48. The claw 46 is movable between a supply position (shown by chained lines in FIG. 5), for guiding the sheet from the copying machine body 1 into a bin 21, and a discharge position (shown by solid lines in FIG. 5), for guiding the sheet discharged from the bin 21 downward.

Figure 5:
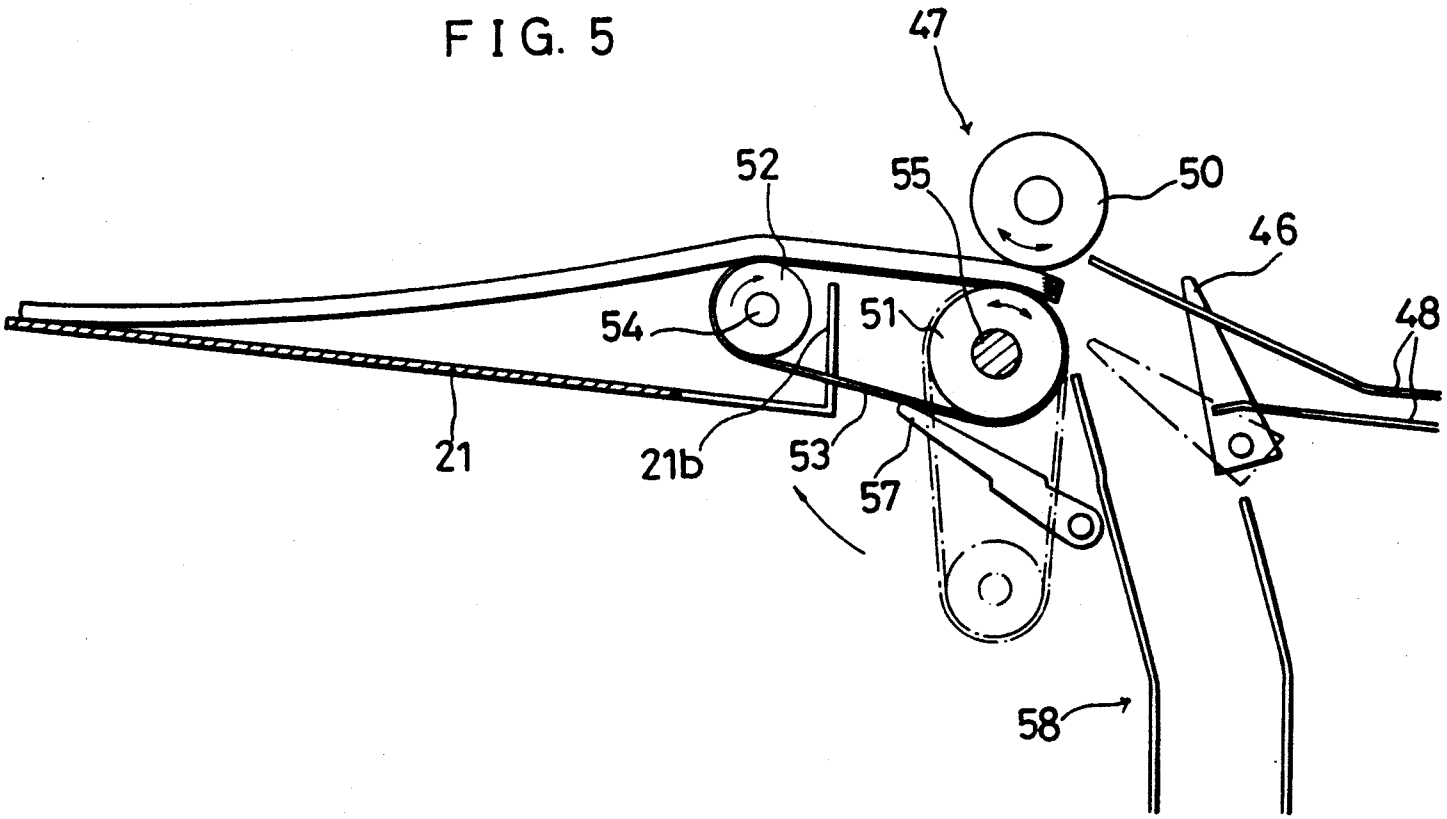
FIG. 5 is a sectional front view showing a discharging mechanism of the sorter.
Figure 6:
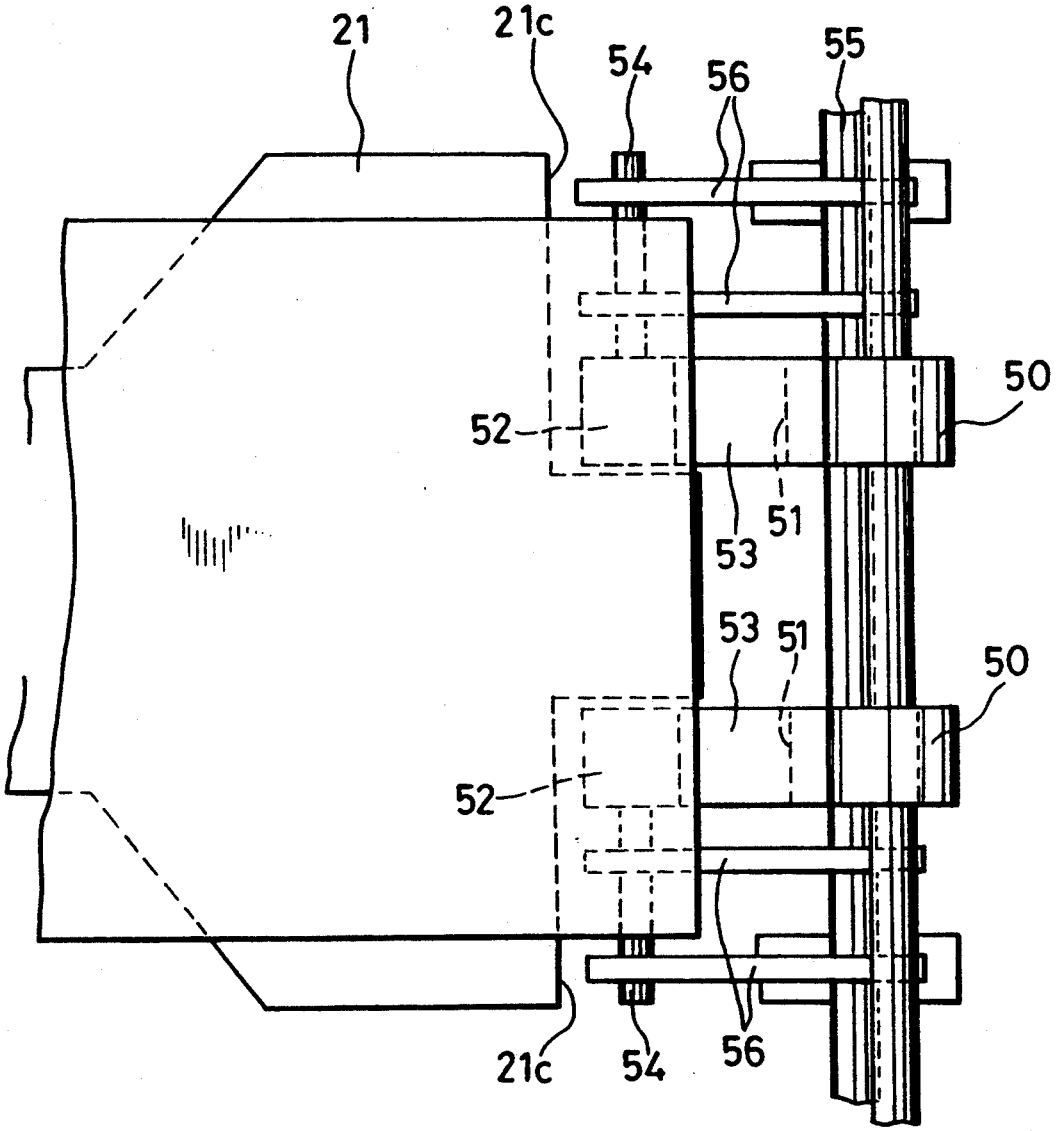
FIG. 6 is a partial plan view of FIG. 5.

With reference made to FIGS. 5 and 6, the transport roller mechanism 47 in specific description includes upper rollers 50 and lower rollers 51 for transporting sheets passing therebetween, auxiliary rollers 52 for drawing a stack of sheets in the corresponding bin 21 toward the rollers 50 and 51, and belts 53 each extending around a corresponding lower roller 51 and auxiliary roller 52. The auxiliary rollers 52 are disposed so as to be upwardly movable through the cutouts 21c in either side of the right end of each bin 21, and are rotatably fixed to respective inward ends of a pair of auxiliary roller shafts 54. The auxiliary roller shafts 54 are rotatably mounted through corresponding ends of pivoting levers 56. The pivoting levers 56 are rotatably supported by a drive shaft 55 which is for rotating the lower rollers 51, and the levers 56 are turned by a motor and gears (not shown). By the turning of the levers 56, the auxiliary rollers 52 can be set into a discharging position, as shown by the solid lines in FIG. 5, or into a retracted position, as shown by the chained lines in FIG. 5. A belt support member 57 is provided under each lower roller 51 to support the belt 53 when located in the discharging position.

Provided beneath the transport roller mechanism 47, is a stack transporting path 58 for guiding, into the stocker 23, bundles of sheets drives downward by the claw 46.

Lateral guides 26 are provided symmetrically on either side in the width direction of the bin 21. Both lateral guides 26 are consist of an "L" formation as shown in FIG. 1 and is turnable toward the central portion of the bins 21 as shown in FIG. 2. A mechanism for turning each lateral guide 26 includes a small pulley 60 fixed to the bottom of the corresponding lateral guide 26, a large pulley 62 fixed to a lateral guide motor 61, and a belt 63 extending around the pulleys 60 and 62. The lateral guides 26 are located at a level relative to the region of the sheet entrance and of the stapling device 22, as shown in FIG. 1. The left ends of the bins 21 as shown in FIG. 1, onto which the leading edges of sheets arrive, are supported by a frame 64.

Operation of the aforementioned will now be described.

When a stapling-sorting mode is selected as a discharge mode, the bins 21 are vertically moved, such that sheets discharged from the copying machine body 1 are sorted into the bins 21, then the sorted sheets are stapled by the stapling device 22. This embodiment, may sort and staple a number of stacks of sheets greater than the number of bins.

In their initial state, all the bins 21 are located under the first cams 35*a*. When sheets begin to be discharged from the discharge rollers 20 of the copying machine body 1, the transport rollers 45 are driven, whereby the sheets are successively transported to the transport roller mechanism 47. During the sorting process, the claw 46 and the auxiliary rollers 52 are in the position indicated by the chained lines in FIG. 5. Consequently, the sheet transported from the transport rollers 45 passes between the upper and lower rollers 50 and 51 and is introduced into the uppermost bin 21.

The right end of the uppermost bin 21 is raised by rotating the cams 35*a* to 35*f* once it has received a sheet, whereby a predetermined space is given between the uppermost bin 21 and the following bin 21, on which state a next sheet discharged from the copying machine body 1 is thus introduced into the following bin 21. Subsequently, while the bins 21 are successively moved upward by rotation of the cams 35*a* to 35*f*, a sheet whereon a first original has been copied is stored into each bin 21. At the end of the copy process of the first original, an automatic original feeder 10 replaces the first original with a second one. Then, the bins 21 are successively lowered by rotation of the cams 35*a* to 35*f* in the direction opposite that of the aforedescribed procedure, whereby sheets whereon the second original has been copied are sorted and stored into the respective bins 21.

Thus, copy-processed sheets are sorted into the bins 21, by means of the vertical movement of the bins 21 by the bin moving mechanism 25.

The operation of transporting the bins 21 will be described, referring to FIGS. 7A through 7I.

Figure 7C:
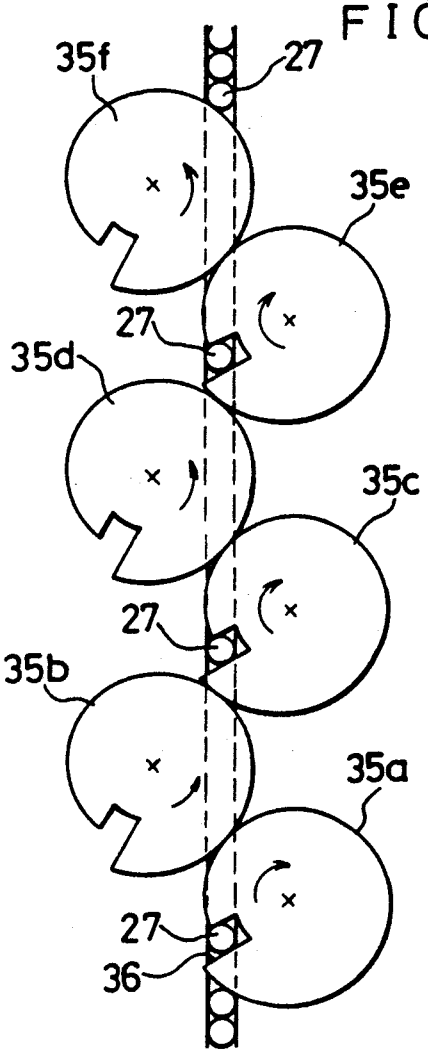
FIGS. 7A to 7I are views for explaining operation of the bin moving mechanism.
Figure 7B:
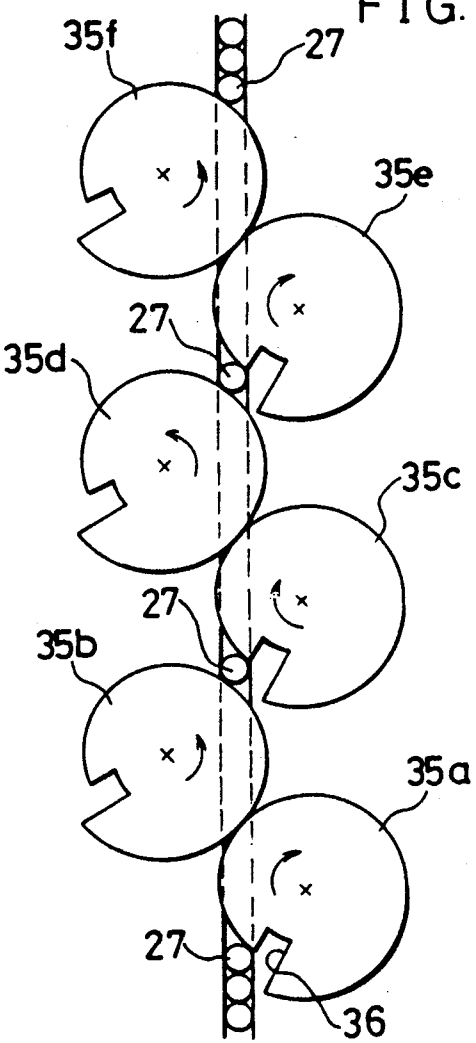
Figure 7A:
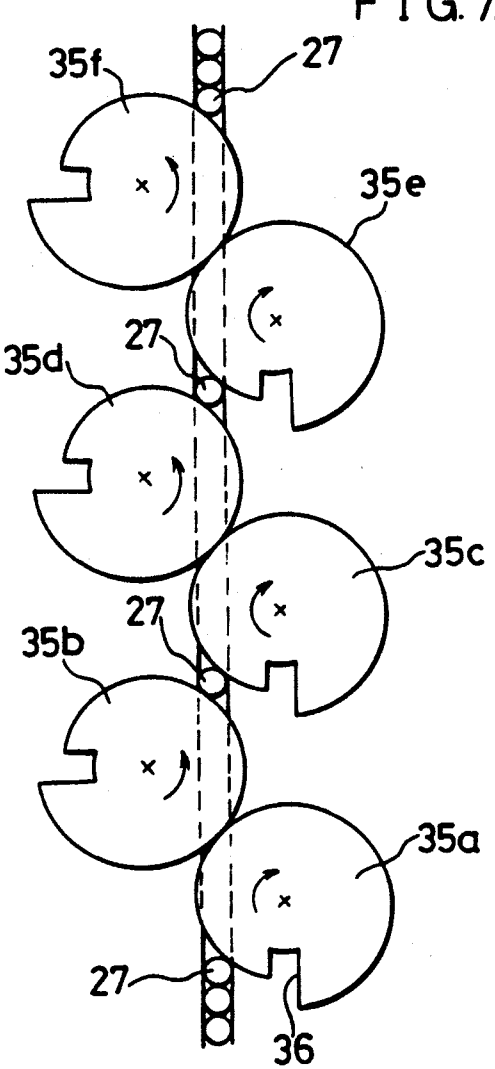

FIG. 7A shows a state in which the bins 21 are being transported upward. In this state, there is a trunnion 27 between both the second and third cams 35*b* and 35*c*, and between the fourth and fifth cams 35*d* and 35*e*. Accordingly, predetermined spaces as defined by the outer diameters of the cams are provided over and under the two bins to which the trunnions 27 transported by the bin moving mechanism 25 pertain. The supply/discharge mechanism 24 and the upper and lower portions of the stapling device 22 are located relative to these three spaces as described previously.

When the first cams 35*a* are rotated clockwise from the state shown in FIG. 7A, the third and fifth cams 35*c* and 35*e* are rotated clockwise as well by means of the gears 40 and 41, while the second, fourth and sixth cams 35*b*, 35*d* and 35*f* are rotated counterclockwise. When the cams 35*a* to 35*f* are rotated thus, the relative positions of the cams progress to the relation as shown in FIG. 7B and then to the relation as shown in FIG. 7C, in which the trunnions 27 located under the first, third and fifth cams 35*a*, 35*c* and 35*e* become engaged in the slots 36 of the respective cams. Next, as shown in FIGS. 7D and 7E, the trunnions 27 in the slots 36 are raised by the rotations of the cams 35*a* to 35*f*. Then, as shown in FIGS. 7E and 7F, the trunnions 27 engaged in the slots 36 of the first, third and fifth cams 35*a*, 35*c* and 35*e* are transferred into the slots 36 of the upwardly adjacent second, fourth and sixth cams 35*b*, 35*d* and 35*f*, respectively.

Figure 7F:
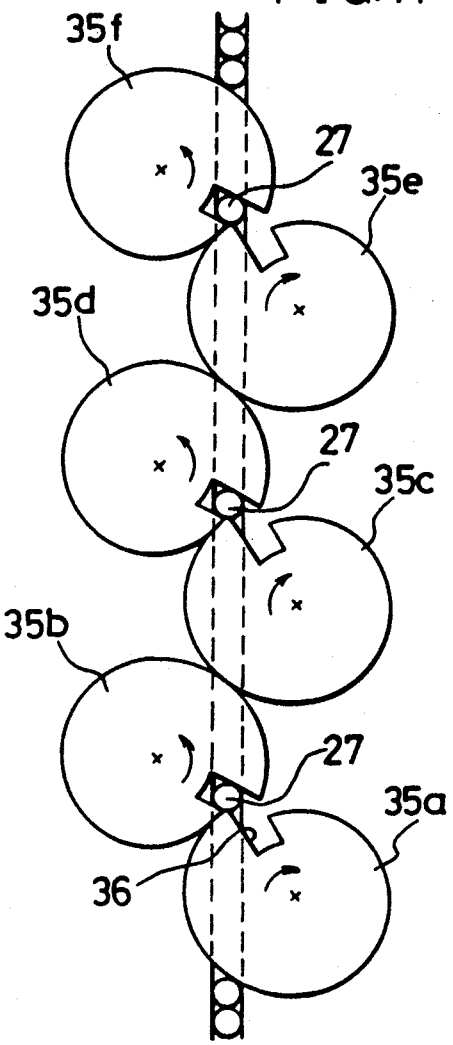
Figure 7E:
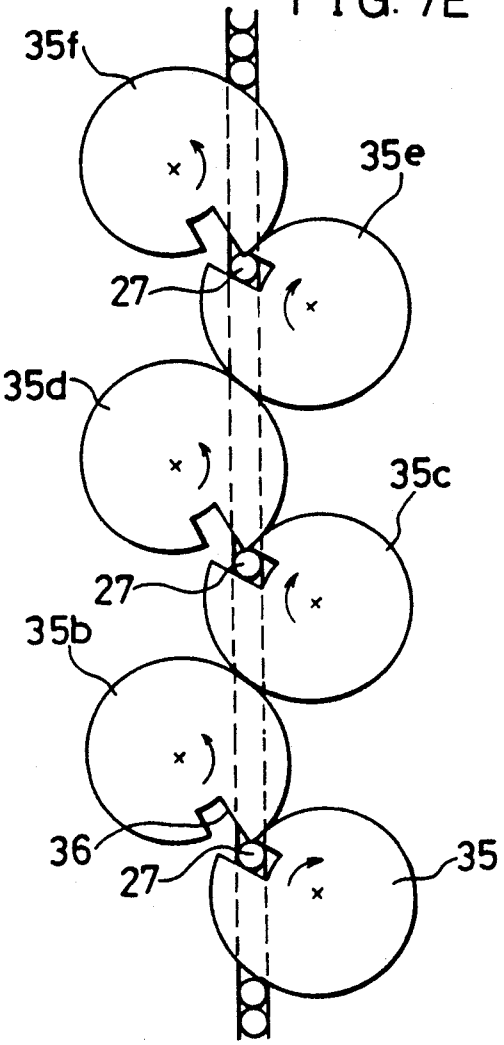
Figure 7D:
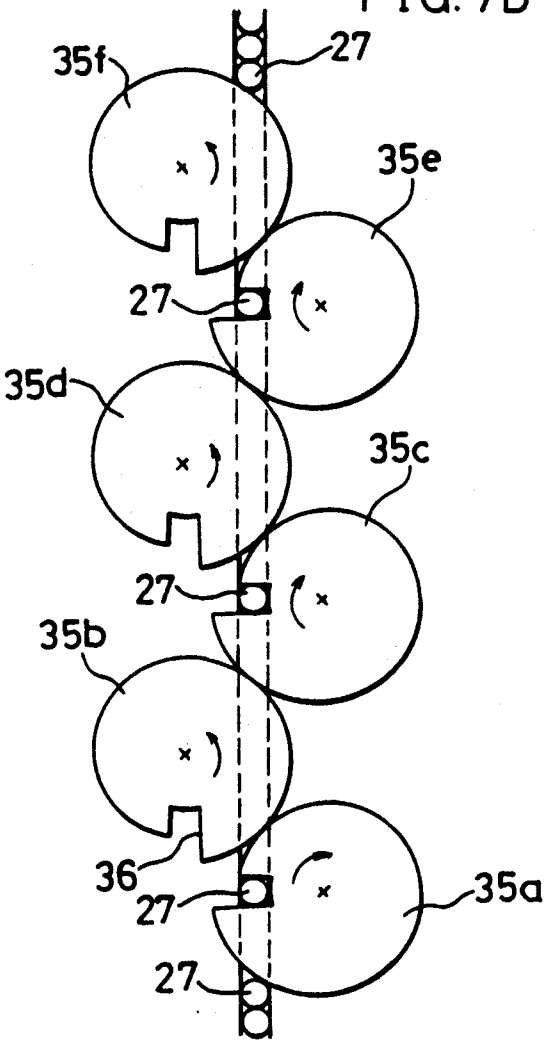
Figure 7I:
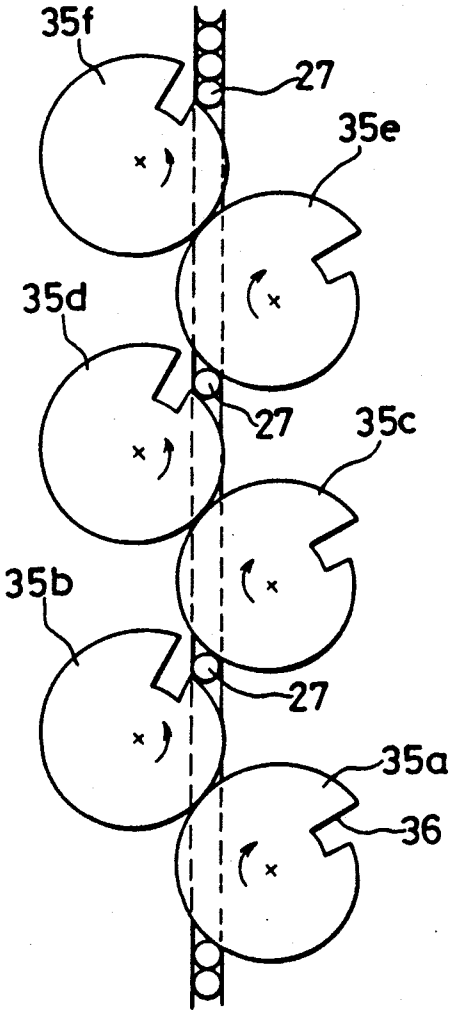
Figure 7H:
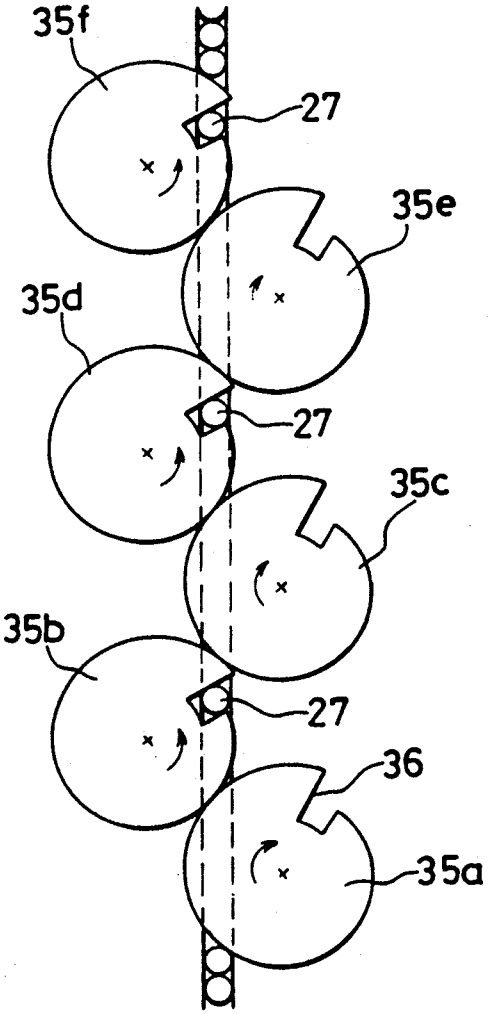
Figure 7G:
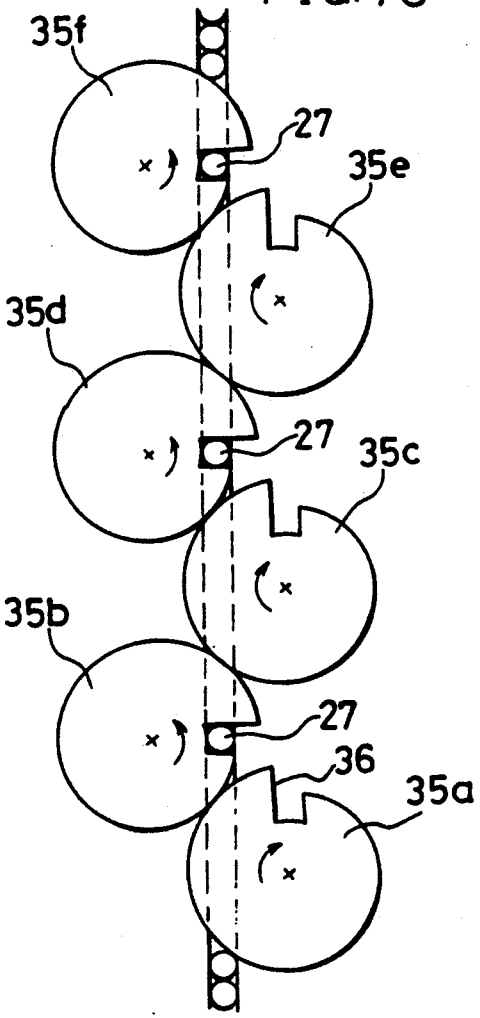

When the cams 35*a* to 35*f* further are rotated from the state shown in FIG. 7F, the trunnions 27 engaged in the slots 36 of the second, fourth and sixth cams 35*b*, 35*d* and 35*f* exit therefrom and become located between the second and third cams 35*b* and 35*c*, between the fourth and fifth cams 35*d* and 35*e*, and on the sixth cams 35*f*, respectively, as shown in FIGS. 7G, 7H and 7I.

When the cams 35*a* to 35*f* are rotated further, they progress into the relation as shown in FIG. 7A again. These operations are repeated, whereby the trunnions 27 are successively moved upward.

By virtue of the upward movement of the trunnions 27, the rod 29 and the bars 30 are moved upward also, whereby those trunnions 27 which are under the first cams 35*a* are moved upward and become engaged into the slots 36 of the first cams 35*a*.

When all the originals have been copied and the copy sheets have been stored into all the bins 21, the bins 21 will be located either over or under the bin moving mechanisms 25, depending on whether the number of originals is an even or an odd number.

The uppermost or lowermost bin 21 is then moved upward or downward by means of the bin moving mechanism 25 according to the manner as described above. Consequently, each bin 21 is moved into the position corresponding to the stapling device 22, wherein the stack of sheets in the bin 21 is stapled by the stapling device 22. The stapling device 22 is located at the drawn position as shown in FIG. 1 while the bins 21 are moving. Each time one of the bins 21 is brought into the stapling position, the stapling device 22 is moved in the direction leftward in the figure by means of a drive mechanism, not shown, wherein the stack of sheets in the bin 21 is nipped and then stapled by the stapling device 22 as indicated in FIG. 2.

A bin 21 having a stack of sheets thus stapled is moved upward or downward by means of the bin moving mechanisms 25. During the stapling process, the claw 46 of the discharging mechanism 24 is in the position shown by the solid lines in FIG. 5. If the stapling processing starts with the lowest bin 21, the auxiliary rollers 52 will be located in the delivery position, in which the tops of the rollers 52 are higher than the stop 21*b*, as shown by the solid lines in FIG. 5. While the bin 21 containing the stapled stack of sheets is being lowered, the trailing edge of the stack of sheets is set onto the auxiliary rollers 52 and becomes raised to a level allowing the stack to pass over the stop 21*b*. The stack of sheets is then transported in the direction rightward in FIG. 5 by means of the auxiliary rollers 52 and the belts 53. Upon reaching the transport roller mechanism 47 the stack of sheets is further transported rightward in FIG. 5 by means of the upper and lower rollers 50 and 51 rotating in the direction opposite that of the sorting process, wherein directed by the claw 46, the stack is discharged into the stack transporting path 58. The stack of sheets passing through the stack transporting path 58 is stored into the stocker 23 provided below the path 58. The above-described discharging operation is performed for each of the bins 21, and all the stapled stacks of sheets in the bins 21 are stored into the stocker 23.

If the stapling process starts with the uppermost bin 21, the auxiliary rollers 52 are moved between the position shown by the solid lines in FIG. 5 and the position indicated by the chained lines each time the bins 21 proceed upward so as not to obstruct vertical passage of the next stack of sheets to be processed. Each stapled stack of sheets is discharged from each bin 21 in the same manner as described above, irrespective of whether the bins 21 move upward or downward.

After the stapled stacks of sheets have been discharged from all the bins 21, the bins 21 are returned to their initial state, and the above-described operation is repeated until the completion of the sorting and stapling operation for the preset number of copies. When the copying process has produced a number of copies of a particular original equal to the number of bins, the original is placed into the original placing portion 11 of the automatic original feeder 10. The originals replaced into the original placing portion 11 can be automatically refed, i. e., recirculated through the automatic original feeder 10.

In the above-described embodiment, the transport roller mechanism 47 both supplies sheets into the bins 21 and discharges the stapled stacks of sheets from the bins 21 into the stocker 23, thus the mechanism for discharging the stacks of sheets is simplified. In addition, the prescribed spacings which are maintained above and below the bin 21 which is in the stapling position and above the bin 21 which is in the sheet supply position while the bins 21 are transported, provide that the supply/discharge mechanism 24 can be located close to the stapling device 22. This allows the stacks of sheets to be stapled with greater facility and more accuracy compared to conventional apparatus, in which sorted sheets must be transported to a different storing portion in order to be stapled. According to the above-described embodiment, since the supply/discharge mechanism 24 and the stapling device 22 are provided in different positions, it is not necessary to provide further a mechanism for rotating the stapling device 22. Thus the structure is therein simplified.

Furthermore, since a stapled stack of sheets is discharged into the stocker 23 by being passed over the stop 21*b*by means of the rotation of the auxiliary rollers 52, the mechanism for discharging the stapled stacks of sheets is simplified in this respect as well.

According to the above-described embodiment, the lateral guides 26 are provided only in positions corresponding to the sheet entrance and the stapling device, and accordingly are compactly disposed.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sorter incorporating a stapler for sorting and stapling sheets discharged from a discharger of an image forming apparatus, comprising:

a plurality of sheet storers arranged vertically;

means for stapling stacks of sheets stored in said sheet storers;

supply/discharge means, including a plurality of pairs of main rollers rotatable in both sheet supplying and discharging directions, for supplying sheets from said image forming apparatus into said sheet storers, and discharging the sheets stored in said sheet storers; and a stacker for storing the sheets discharged from said sheet storers by said supply/discharge means.

2. A sorter according to claim 1, wherein at least one end of each said sheet storer whereon trailing edges of sheets are placed is vertically movable, said sorter further comprising sheet storer transporting means for vertically moving said plurality of sheet storers.

3. A sorter according to claim 2, wherein said supply/discharge means discharges the sheets from said sheet storers in a direction opposite a sheet supplying direction.

4. A sorter according to claim 2, wherein said stapling means is disposed over said supply/discharge means, and said sheet storer transporting means moves said plurality of sheet storers in vertical succession meanwhile maintaining predetermined spacings above and below each successive sheet storer which comes into position corresponding to said stapling means, and predetermined spacing above each storer which at the same time comes into position corresponding to said supply/discharge means.

5. A sorter according to claim 3, wherein said stacker is located under said plurality of sheet storers, said sorter further comprising a sheet transporting path disposed between the discharger of said image forming apparatus and said supply/discharge means, a sheet bundle transporting path disposed between said supply/discharge means and said stocker, and transport guide members disposed at a junction between said sheet transporting path and said sheet bundle transporting path, and movable between a supply position for guiding a sheet from said sheet transporting path to said supply/discharge means and a discharge position for guiding a sheet bundle from said supply/discharge means to said sheet bundle transporting path.

6. A sorter according to claim 5, wherein said supply/discharge means further includes:

a plurality of auxiliary rollers rotatable in the sheet discharging direction and movable between a discharge position, enabling an end of a stack of sheets to be discharged from the corresponding sheet storage and raising the stack to a predetermined level, and a drawn position which is apart from the bottom surface of the stack of sheets; and a plurality of belts, each of which extends around each said auxiliary roller and one roller of each said pair of main rollers and contacts the bottom surface of the stack of sheets when said auxiliary rollers are in the discharge position.

7. A sorter having a stapler for sorting and stapling sheets discharged from a discharger of an image forming apparatus, comprising:

a plurality of sheet storers arranged vertically of which at least those ends whereon trailing edges of sheets are placed are vertically movable;

supply/discharge means, including a plurality of pairs of main rollers rotatable in both sheet supplying and discharging directions, for supplying sheets from said image forming apparatus into said sheet storers, and discharging the sheets stored in said sheet storers;

stapling means disposed over said sheet supplying means for stapling a stack of sheets stored in each of said sheet storers; and sheet storage transporting means for moving said plurality of sheet storers in vertical succession meanwhile maintaining predetermined spacings above and below each successive sheet storer which comes into position corresponding to said stapling means, and predetermined spacing above each storer which at the same time comes into position corresponding to said sheet supplying means.

8. A sorter according to claim 7, wherein said sheet supplying means is disposed between the discharger of said image forming apparatus and said plurality of sheet storers, said sorter further comprising a stacker disposed under said plurality of sheet storers for storing the sheet bundles discharged from said sheet storers, and a sheet bundle transporting path for guiding sheet bundles into said stacker, said sheet bundle transporting path being disposed between said sheet supplying means and said stacker.

9. A sorter according to claim 7, wherein said sheet storer moving means includes at least one plurality of cams vertically arranged, each cam of which is radially slotted, and at least one drive mechanism for rotating said plurality of cams in association, and each said sheet storer has a member engageable with the slot of each said cam.

10. A sorter according to claim 9, wherein the circumference of each said cam is an equivalent portion of an Archimedes' spiral of which the ratio of an increase in radius to the corresponding rotational angle is constant, and those of said cams which are adjacent have a phase difference of $\pi/2$.

11. A stapler for stapling sheets discharged from a discharger of an image forming apparatus, comprising:

a sheet storer for storing the sheets from said image forming apparatus, said sheet storer having a stop of a predetermined height on an end of the storer whereon trailing edges of sheets are placed;

stapling means for stapling the sheets in said sheet storer;

supply/discharge means, including a plurality of pairs of main rollers rotatable in both sheet supplying and discharging directions, for raising the trailing edges of the sheet bundles in the sheet storer to a level allowing the sheets bundles to pass over said stop, and for discharging the raised sheet bundles from said sheet storer; and a stacker for storing the sheet bundles discharged by said discharge means.

12. A stapler according to claim 11, wherein said sheet storer is sloped such that the end of the storer whereon trailing edges of sheets are placed is lower than the opposite end of the storer whereon leading edges of sheets are placed.

13. A stapler according to claim 11, wherein said sheet storage has a bottom surface provided with cutouts, and said discharge means includes drive rollers, auxiliary rollers movable between a discharge position, wherein said auxiliary rollers pass through said cutouts and push upward a portion of the bottom surface of the stack of sheets in said sheet storer, and a drawn position wherein said auxiliary rollers are apart from said bottom surface of the stack of sheets, and belts extending around said drive rollers and said auxiliary rollers and contacting the bottom surface of the stack of sheets when said auxiliary rollers are in the discharge position.

14. A stapler according to claim 12, wherein said discharging means is disposed between the discharger of said image forming apparatus and said sheet storer, and is for discharging a stack of sheets from said sheet storer in a direction opposite a sheet supplying direction, and said stacker is disposed under said sheet storer, said stapler further comprising a stack transporting path for guiding the stack of sheets from said discharge means into said stacker.

15. A stapler according to claim 14, wherein said discharge means further includes supply means for supplying sheets from said image forming apparatus to said sheet storer.

16. A stapler for stapling sheets discharged from a discharger of an image forming apparatus, comprising:

a sheet storer for storing the sheets discharged from the discharger of said image forming apparatus:

stapling means for stapling a stack of sheets stored in said sheet storer;

supplying/discharging means, including a plurality of pairs of main rollers rotatable in both sheet supplying and discharging directions, for supplying the sheets from said image forming apparatus to said sheet storage, and discharging the stack of sheets stored in said sheet storage; and a stacker for storing the stack of sheets discharged from said sheet storer by said supplying/discharging means.

17. A stapler according to claim 16, wherein said supplying/discharging means is disposed between the discharger of said image forming apparatus and said sheet storer, and discharges the stack of sheets from said sheet storer in a direction opposite a sheet supplying direction.

18. A stapler according to claim 17, wherein said stacker is disposed under said sheet storer, said stapler further comprising:

a sheet transporting path disposed between the discharger of said image forming apparatus and said supplying/discharging means;

a stack transporting path provided between said supplying/discharging means and said stacker; and transporting guide members disposed at a junction between said sheet transporting path and said stack transporting path, and movable between a supply position for guiding the sheets from said sheet transporting path to said supplying/discharging means, and a discharge position, for guiding the sheets from said supplying/discharging means to said stack transporting path.

* * * * *